US010047323B2

(12) United States Patent
Letzelter et al.

(10) Patent No.: US 10,047,323 B2
(45) Date of Patent: Aug. 14, 2018

(54) DETERGENT COMPOSITION COMPRISING MGDA AND A SULFONATED COPOLYMER

(71) Applicant: The Procter & Gamble Company, Cincinnati, OH (US)

(72) Inventors: Nathalie Sophie Letzelter, Trimdon (GB); Ashmita Randhawa, Newcastle upon Tyne (GB); Sandrine Annette Henriette Viallet, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/008,472

(22) Filed: Jan. 28, 2016

(65) Prior Publication Data

US 2016/0222325 A1 Aug. 4, 2016

(30) Foreign Application Priority Data

Feb. 2, 2015 (EP) ..... 15153513

(51) Int. Cl.

| | |
|---|---|
| ***C11D 3/33*** | (2006.01) |
| ***C11D 3/386*** | (2006.01) |
| ***C11D 3/39*** | (2006.01) |
| ***C11D 3/22*** | (2006.01) |
| ***C11D 3/37*** | (2006.01) |
| ***C11D 17/00*** | (2006.01) |
| ***C11D 17/04*** | (2006.01) |

(52) U.S. Cl.

CPC ..... *C11D 3/3942* (2013.01); *C11D 3/225* (2013.01); *C11D 3/33* (2013.01); *C11D 3/378* (2013.01); *C11D 3/3761* (2013.01); *C11D 3/386* (2013.01); *C11D 3/3905* (2013.01); *C11D 3/3907* (2013.01); *C11D 3/3932* (2013.01); *C11D 17/0091* (2013.01); *C11D 17/042* (2013.01); *C11D 17/045* (2013.01)

(58) Field of Classification Search

CPC ..... C11D 3/378

See application file for complete search history.

(56) References Cited

U.S. PATENT DOCUMENTS

| | | | | |
|---|---|---|---|---|
| 6,265,371 | B1 | 7/2001 | Hagino et al. | |
| 2002/0137657 | A1 | 9/2002 | Lant et al. | |
| 2003/0045437 | A1* | 3/2003 | Ward | B65D 77/046 510/218 |
| 2005/0061704 | A1 | 3/2005 | Cole et al. | |
| 2006/0079425 | A1* | 4/2006 | Kapur | C11D 3/06 510/220 |
| 2008/0045430 | A1 | 2/2008 | Witteler et al. | |
| 2008/0081774 | A1 | 4/2008 | Koch | |
| 2010/0041575 | A1* | 2/2010 | Warkotsch | C11D 3/378 510/228 |
| 2010/0075886 | A1* | 3/2010 | Brooker | C11D 3/1213 510/226 |
| 2010/0105596 | A1 | 4/2010 | Wiedemann et al. | |
| 2010/0294309 | A1* | 11/2010 | Tropsch | C11D 3/378 134/18 |
| 2010/0294310 | A1 | 11/2010 | Kaiser et al. | |
| 2012/0058927 | A1 | 3/2012 | Borchers et al. | |
| 2012/0067373 | A1* | 3/2012 | Souter | C11D 3/33 134/18 |
| 2012/0094889 | A1 | 4/2012 | Borchers et al. | |
| 2012/0097193 | A1 | 4/2012 | Rossetto et al. | |
| 2013/0199569 | A1* | 8/2013 | Cabirol | C11D 3/33 134/18 |
| 2014/0027669 | A1* | 1/2014 | Detering | C11D 3/3715 252/180 |
| 2015/0126426 | A1 | 5/2015 | Kumar et al. | |
| 2015/0329803 | A1* | 11/2015 | Caires | C11D 3/08 510/230 |
| 2015/0336692 | A1* | 11/2015 | Brandt Sanz | B65B 37/00 53/450 |
| 2015/0337278 | A1* | 11/2015 | Andersen | C12N 9/2417 435/201 |
| 2016/0040098 | A1* | 2/2016 | Nunes | C11D 1/06 134/18 |
| 2016/0060611 | A1* | 3/2016 | Alekseyev | C12N 9/54 510/226 |
| 2016/0152929 | A1 | 6/2016 | Reinhardt et al. | |
| 2016/0222321 | A1 | 8/2016 | Letzelter et al. | |
| 2016/0222323 | A1 | 8/2016 | Letzelter et al. | |
| 2016/0222324 | A1 | 8/2016 | Letzelter et al. | |
| 2016/0222330 | A1 | 8/2016 | Letzelter et al. | |

FOREIGN PATENT DOCUMENTS

| | | | |
|---|---|---|---|
| DE | 19518695 | A1 | 11/1996 |
| DE | 102013010150 | A1 | 12/2014 |
| EP | 1905818 | A1 | 4/2008 |
| EP | 2380961 | * | 10/2011 |
| EP | 2380961 | A1 | 10/2011 |
| EP | 2662436 | A1 | 11/2013 |
| WO | WO 95/28464 | A1 | 10/1995 |
| WO | 2009092699 | * | 7/2009 |
| WO | WO 2009/092699 | A1 | 7/2009 |
| WO | 2011027170 | * | 3/2011 |

(Continued)

OTHER PUBLICATIONS

EP Search Report, 8 Pages.
EP Search Report, 9 Pages.
EP Search Report, 11 Pages.
EP Search Report, 7 Pages.
U.S. Appl. No. 15/008,474, filed Jan. 28, 2016, Letzelter, et al.

(Continued)

*Primary Examiner* — Charles I Boyer
(74) *Attorney, Agent, or Firm* — John T. Dipre

(57) ABSTRACT

A phosphate-free automatic dishwashing detergent composition in unit-dose form having a weight of from about 8 to about 25 grams, the composition comprising:

i) greater than about 5 to about 8 grams of an organic complexing agent;
ii) a dispersant polymer;
iii) from about 1 to about 3 grams of bleach and wherein the complexing agent and the dispersant polymer are in a weight ratio of from about 5:1 to about 25:1.

8 Claims, No Drawings

(56) References Cited

FOREIGN PATENT DOCUMENTS

| | | | |
|---|---|---|---|
| WO | WO 2011/027170 | A2 | 10/2011 |
| WO | WO 2011/130076 | A1 | 10/2011 |
| WO | WO 2012/0000914 | A1 | 1/2012 |
| WO | WO 2012/025740 | A1 | 4/2012 |
| WO | WO 2012/085534 | A1 | 6/2012 |
| WO | WO 2014/027181 | A1 | 2/2014 |
| WO | WO 2014/184280 | A1 | 11/2014 |
| WO | WO 2015/124384 | A1 | 8/2015 |

OTHER PUBLICATIONS

U.S. Appl. No. 15/008,476, filed Jan. 28, 2016, Letzelter, et al.
U.S. Appl. No. 15/008,477, filed Jan. 28, 2016, Letzelter, et al.
U.S. Appl. No. 15/008,478, filed Jan. 28, 2016, Letzelter, et al.
International Search Report; International Application No. PCT/US2016/015875; dated Apr. 25, 2016; 15 pages.
International Search Report; International Application No. PCT/US2016/015877; dated Apr. 26, 2016; 16 pages.
International Search Report; International Application No. PCT/US2016/015878; dated Apr. 26, 2016; 16 pages.
International Search Report; International Application No. PCT/US2016/015905; dated May 6, 2016; 14 pages.
International Search Report; International Application No. PCT/US2016/015904; dated May 6, 2016; 14 pages.
MonoSol M8630 76u Film Data Sheet; 1 page; Mar. 6, 2012.
MonoSol- Client Resources for your use; M8630 Film Data Sheet; pp. 1-5; Mar. 2012.

* cited by examiner

DETERGENT COMPOSITION COMPRISING MGDA AND A SULFONATED COPOLYMER

TECHNICAL FIELD

The present invention is in the field of cleaning. It relates to a cleaning product, in particular to a phosphate-free automatic dishwashing detergent composition comprising a high level of a complexing agent and a low level of a polymer. The composition provides good cleaning, finishing, care and presents a good environmental profile.

BACKGROUND OF THE INVENTION

Automatic dishwashing detergents in unit-dose form have become increasingly popular. One of the constrains of products in unit-dose form is that they present a limited volume-determined by the size of the product dispenser in the dishwasher—limiting the amount of active that the detergent can contain. Traditionally automatic dishwashing detergents were based on phosphate, however due to environmental concerns the use of phosphate is avoided.

The automatic dishwashing detergent formulator is continuously looking for ways to improve the performance and environmental profile of detergent compositions. Sometimes there are negative interactions between ingredients in products and/or in the wash, for example high levels of complexing agents can negatively impact on the performance of enzymes, in particular on the performance of proteases.

Baked-on, burnt-on soils and bleachable stains are among the most difficult soils and stains to remove. The automatic dishwasher detergent not only need to provide good cleaning but also good finishing (lack of filming and spotting and provide shine) and care.

US2010/0041575 A1 proposes a way to formulate phosphate-free detergents however the cleaning provided by the compositions of '575 can still be improved.

The objective of the present invention is to provide an automatic dishwashing detergent composition with a good environmental profile that provides: i) good cleaning, including difficult to remove soils such as baked-on, burnt-on soils and bleachable stains, ii) good finishing, i.e., leave the washed items free of filming and spotting and shining, and iii) good care, in particular glass items that are prone to deterioration during automatic dishwashing and avoiding the staining of stainless steel items.

SUMMARY OF THE INVENTION

According to the first aspect of the invention, there is provided a phosphate-free automatic dishwashing detergent composition. By "phosphate-free" is herein understood that the composition comprises less than 1%, preferably less than 0.1% by weight of the composition of phosphate. The composition comprises bleach, high level of complexing agent and low level of polymer. The composition provides good cleaning, including: i) the removal of bleachable stains, in particular tea stains; ii) the removal of proteinaceous soils, in particular egg-containing soils and meat; iii) the removal of burnt-on, baked-on soils. The composition also provides good shine, by preventing filming and spotting. It also provides good care specially by avoiding the formation of a coloured film on stainless steel items. The composition is environmentally friendly due to the biodegradability of the complexing agent and the low level of polymer used.

The composition of the invention is in unit-dose form. By "unit-dose form" is herein meant that the composition is provided in a form sufficient to provide enough detergent for one wash. Suitable unit dose forms include tablets, sachets, capsules, pouches, etc. Preferred for use herein are compositions in unit-dose form wrapped in water-soluble material, for example polyvinyl alcohol. Especially preferred are compositions in unit dose form wrapped in a polyvinyl alcohol film having a thickness of less than 100 μm. The detergent composition of the invention weighs from about 8 to about 25 grams, preferably from about 10 to about 20 grams. This weight range fits comfortable in a dishwasher dispenser. Even although this range amount to a low amount of detergent, the detergent has been formulated in a way that provides all the benefits mentioned herein above.

The composition of the invention comprises a high level of an organic complexing agent. It comprises greater than about 5 to about 10, preferably greater than about 5.8 to about 9 and especially equal or greater than about 6 to about 8 grams of complexing agent. For the purpose of this invention a "complexing agent" is a compound capable of binding polyvalent ions such as calcium, magnesium, lead, copper, zinc, cadmium, mercury, manganese, iron, aluminium and other cationic polyvalent ions to form a water-soluble complex. The complexing agent has a logarithmic stability constant ([log K]) for Ca2+ of at least 5, preferably at least 6. The stability constant, log K, is measured in a solution of ionic strength of 0.1, at a temperature of 25° C.

The complexing agent is preferably selected from the group consisting of methyl-glycine-diacetic acid (MGDA), its salts and derivatives thereof, glutamic-N,N-diacetic acid (GLDA), its salts and derivatives thereof, iminodisuccinic acid (IDS), its salts and derivatives thereof, carboxy methyl inulin, its salts and derivatives thereof and mixtures thereof. Especially preferred complexing agent for use herein is selected from the group consisting of MGDA and salts thereof, especially preferred for use herein is the three sodium salt of MGDA.

The composition of the invention also comprises a dispersant polymer. A dispersant polymer is a polymer capable of: i) dispersing inorganic salts such as those coming from water hardness and from detergent ingredients such as carbonate; and/or ii) disperse organic food residues found on the dirty dishware.

For the purpose of this invention "dishware" encompasses tableware and cookware and anything that it is usually washed in an automatic dishwasher.

The complexing agent and the polymer are in a weight ratio of from about 5:1 to about 30:1, preferably from about 10:1 to about 20:1, more preferably from about 12:1 to about 18:1. It has been surprisingly found that compositions with this ratio provide good cleaning, lack of filming and unexpectedly improved lack of spotting.

Preferably, the dispersant polymer is selected from the group consisting of alkoxylated polyalkyleneimines, polymeric polycarboxylates, including alkoxylated polycarboxylates, polymers of unsaturated monomeric acids, polyethylene glycols, styrene co-polymers, cellulose sulfate esters, carboxylated polysaccharides, amphiphilic graft copolymers, sulfonated polymers and mixtures thereof. Preferably the dispersant polymer is a sulfonated polymer. For the purpose of this invention a "sulfonated polymer" is a polymer comprising sulphur in any of its forms. The "sulfonated polymer" of the invention preferably comprises carboxyl groups.

Preferably, the complexing agent is the three sodium salt of MGDA and the dispersant agent is a sulfonated polymer, more preferably comprising 2-acrylamido-2-methylpropane sulfonic acid, monomer.

It has been observed that some phosphate-free automatic dishwashing compositions can leave a coloured film on stainless steel items. This problem is ameliorated or even avoided when the composition of the invention is free of citrate.

It has also been observed that compositions comprising high level of complexing agents can negatively affect enzyme performance, in particular the performance of proteases and if the level of complexing agent is higher the performance of amylase can also be impacted. It has been surprising found that the composition of the invention provides very good removal of proteinaceous soils.

Preferably the composition of the invention comprises a low level of a crystal growth inhibitor, more preferably 1-hydroxyethylidene 1,1-diphosphonic acid (HEDP).

Preferably, the composition of the invention has a pH of from 9 to 12, more preferably from about 10 to about 11.5 as measured in 1% weight/volume aqueous solution in distilled water at 20° C.

Preferably the composition of the present invention has a reserve alkalinity of 10 or greater, preferably 12 or greater, most preferably 14 or greater. "Reserve alkalinity", as used herein refers to, the ability of an automatic dishwashing composition to maintain an alkali pH in the presence of acid. This is relative to the ability of an automatic dishwashing composition to have sufficient alkali in reserve to deal with any added acid—coming from the water and/or the soils on the dishware—while maintaining the pH.

More specifically, it is defined as the grams of NaOH per 100 cc's, exceeding pH 9.5, in product. The reserve alkalinity for a solution is determined in the following manner.

A pH meter (for example An Orion Model 720A) with a Ag/AgCl electrode (for example an Orion sure flow Electrode model 9172BN) is standardized using pH 7 and pH 10 buffers. A 1% solution of the composition to be tested is prepared in distilled water. The weight of the sample is noted. The pH of the 1% solution is measured and the solution is titrated down to pH 9.5 using a solution of 0.2N HCL. The reserve alkalinity is calculated in the following fashion:

Reserve Alkalinity=% NaOH×Specific Gravity.

% NaOH=ml HCl×Normality of HCl×4'/Weight of Sample Aliquot Titrated

* Equivalent weight of NaOH in the % NaOH equation, derived from:

% NaOH=ml HCl×Normality of HCl×Equiv. Weight NaOH×100/1000×Weight of Sample Aliquot Titrated Cleaning using hard water is particularly challenging. According to a second aspect of the invention, there is provided a method of automatic dishwashing using the composition of the invention, preferably in hard water. Even under hard water conditions, the composition of the invention provides very good cleaning, finishing and care results. By "hard water" is herein meant water having a hardness of equal or greater than 100 ppm, preferably 200 ppm and specially 300 ppm of $CaCO_3$.

According to a third aspect of the invention, there is provided the use of the composition of the invention for the removal of protein-containing soils, in particular egg and/or milk containing soils, preferably in hard water.

The elements of the composition of the invention described in connection with the first aspect of the invention apply mutatis mutandis to the second and third aspects of the invention.

SUMMARY OF THE INVENTION

The present invention encompasses an automatic dishwashing detergent composition. The composition comprises a high level of an organic complexing agent (preferably a salt of MGDA, more preferably the three sodium salt), a low level of polymer (preferably a sulfonated polymer, more preferably a sulfonated polymer comprising 2-acrylamido-2-methylpropane sulfonic acid monomers) and bleach (preferably sodium percarbonate). The composition provides excellent cleaning, finishing, care and is environmentally friendly. There is also provided a method of automatic dishwashing using the composition of the invention and a method of automatic dishwashing in hard water. The composition performs really well even under hard water conditions. The invention also encompasses the use of the composition, preferably in hard water, for the removal of protein-containing soils, preferably egg- and milk-containing soils.

Unit Dose Form

The composition of the invention is presented in unit-dose form. Products in unit dose form include tablets, capsules, sachets, pouches, injection moulded containers, etc. Preferably, the composition is in a pack made of water-soluble material. Preferred packs are pouches, where the detergent composition is enveloped by a water-soluble film and injection moulded containers wherein the detergent composition is placed in a container of water-soluble material made by injection moulding. Both the detergent composition and the enveloping material are water-soluble. They readily dissolve when exposed to water in an automatic dishwashing process, preferably during the main wash. The pack can have a single compartment or a plurality of compartments. The compartments can comprise a composition in liquid or solid form.

Preferably, the unit dose detergent can by in the form of a multi-compartment pack. By "multi-compartment pack" is herein meant a pack having at least two compartments, preferably at least three compartments, each compartment contains a composition surrounded by enveloping material, preferably polyvinyl alcohol. The compartments can be in any geometrical disposition. The different compartments can be adjacent to one another, preferably in contact with one another. Especially preferred configurations for use herein include superposed compartments (i.e. one above the other), side-by-side compartments, etc. Especially preferred from a view point of automatic dishwasher dispenser fit, stability and enveloping material reduction are multi-compartment pouches or containers having some superposed compartments and/or some side-by-side compartments.

Enveloping Material

The enveloping material is water soluble. By "water-soluble" is herein meant that the material has a water-solubility of at least 50%, preferably at least 75% or even at least 95%, as measured by the method set out herein after using a glass-filter with a maximum pore size of 20 microns. 50 grams+−0.1 gram of enveloping material is added in a pre-weighed 400 ml beaker and 245 ml+−1 ml of distilled water is added. This is stirred vigorously on a magnetic stirrer set at 600 rpm, for 30 minutes at 20° C. Then, the mixture is filtered through a folded qualitative sintered-glass filter with a pore size as defined above (max, 20 micron). The water is dried off from the collected filtrate by any conventional method, and the weight of the remaining material is determined (which is the dissolved or dispersed faction). Then, the % solubility can be calculated.

The enveloping material is any water-soluble material capable of enclosing the cleaning composition of the product of the invention. The enveloping material can be a polymer that has been injection moulded to provide a casing or it can be a film. Preferably the enveloping material is made of polyvinyl alcohol. Preferably the enveloping material is a water-soluble polyvinyl alcohol film.

The pouch can, for example, be obtained by injection moulding or by creating compartments using a film. The enveloping material is usually moisture permeable. The pouch of the invention is stable even when the enveloping material is moisture permeable. The liquid composition confers stability to the pouch, in terms of both interaction among the different compositions and interaction with the surrounding environment.

Preferred substances for making the enveloping material include polymers, copolymers or derivatives thereof selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Especially preferred for use herein is polyvinyl alcohol and even more preferred polyvinyl alcohol films.

Most preferred enveloping materials are PVA films known under the trade reference Monosol M8630, as sold by Kuraray, and PVA films of corresponding solubility and deformability characteristics. Other films suitable for use herein include films known under the trade reference PT film or the K-series of films supplied by Aicello, or VF-HP film supplied by Kuraray.

The enveloping material herein may comprise other additive ingredients than the polymer or polymer material and water. For example, it may be beneficial to add plasticisers, for example glycerol, ethylene glycol, diethyleneglycol, propylene glycol, dipropylene glycol, sorbitol and mixtures thereof. Preferably the enveloping material comprises glycerol as plasticisers. Other useful additives include disintegrating aids.

Detergent Composition

The detergent composition of the invention is presented in unit-dose form and it can be in any physical form including solid, liquid and gel form. The composition of the invention is very well suited to be presented in the form of a multi-compartment pack, more in particular a multi-compartment pack comprising compartments with compositions in different physical forms, for example a compartment comprising a composition in solid form and another compartment comprising a composition in liquid form. The composition is preferably enveloped by a water-soluble film such as polyvinyl alcohol. The composition comprises an organic complexing agent, preferably the tri-sodium salt of MGDA, a dispersant polymer, preferably a sulfonated polymer comprising 2-acrylamido-2-methylpropane sulfonic acid monomers, a bleach, preferably sodium percarbonate, and preferably an inorganic builder, more preferably carbonate, a bleach activator, a bleach catalyst, protease and amylase enzymes, non-ionic surfactant, a crystal growth inhibitor, more preferably HEDP. The composition is preferably free of citrate.

The composition of the invention preferably has a pH as measured in 1% weight/volume aqueous solution in distilled water at 20° C. of from about 9 to about 12, more preferably from about 10 to less than about 11.5 and especially from about 10.5 to about 11.5.

The composition of the invention preferably has a reserve alkalinity of from about 10 to about 20, more preferably from about 12 to about 18 at a pH of 9.5 as measured in NaOH with 100 mL of product at 20° C.

Complexing Agent

A complexing agent is a material capable of sequestering hardness ions, particularly calcium and/or magnesium. The composition of the invention comprises a high level of complexing agent, however the level should not be too high due to the negative interaction with enzymes. Too high level can also have glass care issues associated to it.

The composition of the invention comprises greater than about 5 to about 10 grams, preferably greater than about 5.5 to about 8 grams, more preferably greater than about 5.5 to about 8 grams of a complexing agent. The complexing agent is preferably selected from the group consisting of methylglycine-diacetic acid, its salts and derivatives thereof, glutamic-N,N-diacetic acid, its salts and derivatives thereof, iminodisuccinic acid, its salts and derivatives thereof, carboxy methyl inulin, its salts and derivatives thereof and mixtures thereof. Especially preferred complexing agent for use herein is a salt of MGDA, in particular the three sodium salt of MGDA.

Dispersant Polymer

The composition of the invention comprises a low level of dispersant polymer, preferably from about 0.1 to about 1, more preferably from about 0.2 to about 0.9 and particularly from 0.3 to 0.6 grams, preferably the dispersant polymer is a sulfonated polymer, more preferably a sulfonated polymer comprising 2-acrylamido-2-methylpropane sulfonic acid monomers and carboxyl monomers.

Polycarboxylate Polymer

For example, a wide variety of modified or unmodified polyacrylates, polyacrylate/maleates, or polyacrylate/methacrylates are highly useful. It is believed these polymers are excellent dispersing agents and enhance overall detergent performance, particularly when used in the composition of the invention.

Suitable polycarboxylate-based polymers include polycarboxylate polymers that may have average molecular weights of from about 500 Da to about 500,000 Da, or from about 1,000 Da to about 100,000 Da, or even from about 3,000 Da to about 80,000 Da. Suitable polycarboxylates may be selected from the group comprising polymers comprising acrylic acid such as Sokalan PA30, PA20, PAIS, PA10 and sokalan CP10 (BASF GmbH, Ludwigshafen, Germany), Acusol™ 45N, 480N, 460N and 820 (sold by Rohm and Haas, Philadelphia, Pa., USA) polyacrylic acids, such as Acusol™ 445 and Acusol™ 420 (sold by Rohm and Haas, Philadelphia, Pa., USA) acrylic/maleic co-polymers, such as Acusol™ 425N and acrylic/methacrylic copolymers.

Alkoxylated polycarboxylates such as those prepared from polyacrylates are useful herein to and can provide additional grease suspension. Chemically, these materials comprise polyacrylates having one ethoxy side-chain per every 7-8 acrylate units. The side-chains are ester-linked to the polyacrylate "backbone" to provide a "comb" polymer type structure. The molecular weight can vary, but may be in the range of about 2000 to about 50,000.

Unsaturated monomeric acids that can be polymerized to form suitable dispersing polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Co-polymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Sulfonated Polymers

Suitable sulfonated polymers described herein may have a weight average molecular weight of less than or equal to about 100,000 Da, preferably less than or equal to about 75,000 Da, more preferably less than or equal to about 50,000 Da, more preferably from about 3,000 Da to about 50,000, and specially from about 5,000 Da to about 45,000 Da.

The sulfonated polymers preferably comprises carboxylic acid monomers and sulfonated monomers. Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Specially preferred sulfonated polymers for use herein are those comprising monomers of acrylic acid and monomers of 2-acrylamido-methyl propane sulfonic acid.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas, Versaflex Si™ (sold by Alco Chemical, Tennessee, USA) and those described in U.S. Pat. No. 5,308,532 and in WO 2005/090541.

Suitable styrene co-polymers may be selected from the group comprising, styrene co-polymers with acrylic acid and optionally sulphonate groups, having average molecular weights in the range 1,000-50,000, or even 2,000-10,000 such as those supplied by Alco Chemical Tennessee, USA, under the tradenames Alcosperse® 729 and 747.

Other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates. Preferred cellulose-derived dispersant polymers are the carboxymethyl celluloses.

Yet another group of acceptable dispersing agents are the organic dispersing polymers, such as polyaspartates.

Amphilic graft co-polymer are useful for use herein. Suitable amphilic graft co-polymer comprises (i) polyethylene glycol backbone; and (ii) and at least one pendant moiety selected from polyvinyl acetate, polyvinyl alcohol and mixtures thereof. In other examples, the amphilic graft copolymer is Sokalan HP22, supplied from BASF.

Bleach

The composition of the invention preferably comprises from 1 to 4, preferably from 1.2 to 3 and especially from 1.5 to 2.5 grams of bleach.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Preferably, the level of bleach in the composition of the invention is from about 0 to about 10%, more preferably from about 0.1 to about 5%, even more preferably from about 0.5 to about 3% by weight of the composition.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.1 to 2, preferably from 0.2 to 1 grams of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16.

Manganese bleach catalysts are preferred for use in the composition of the invention. Especially preferred catalyst for use here is a dinuclear manganese-complex having the general formula:

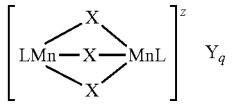

wherein Mn is manganese which can individually be in the III or IV oxidation state; each x represents a coordinating or bridging species selected from the group consisting of H2O, O22-, O2-, OH—, HO2-, SH—, S2-, >SO, N3-, SCN—, RCOO—, NH2- and NR3, with R being H, alkyl or aryl, (optionally substituted); L is a ligand which is an organic molecule containing a number of nitrogen atoms which coordinates via all or some of its nitrogen atoms to the manganese centres; z denotes the charge of the complex and is an integer which can be positive or negative; Y is a monovalent or multivalent counter-ion, leading to charge neutrality, which is dependent upon the charge z of the complex; and q=z/[charge Y]

Preferred manganese-complexes are those wherein x is either $CH_3COO^-$ or $O^2$ or mixtures thereof, most preferably wherein the manganese is in the IV oxidation state and x is $O^{2-}$. Preferred ligands are those which coordinate via three nitrogen atoms to one of the manganese centres, preferably being of a macrocyclic nature. Particularly preferred ligands are:

(1) 1,4,7-trimethyl-1,4,7-triazacyclononane, (Me-TACN); and (2) 1,2,4,7-tetramethyl-1,4,7-triazacyclononane, (Me-Me TACN).

The type of counter-ion Y for charge neutrality is not critical for the activity of the complex and can be selected from, for example, any of the following counter-ions: chloride; sulphate; nitrate; methylsulphate; surfactant anions, such as the long-chain alkylsulphates, alkylsulphonates, alkylbenzenesulphonates, tosylate, trifluoromethylsulphonate, perchlorate ($ClO_4^-$), $BPh_4^-$ and $PF_6^-$' though some counter-ions are more preferred than others for reasons of product property and safety.

Consequently, the preferred manganese complexes useable in the present invention are:

(I) $[(Me\text{-}TACN)Mn^{IV}(Âμ\text{-}0)_3Mn^{IV}(Me\text{-}TACN)]^{2+}(PF_6^-)_2$ (II) $[(Me\text{-}MeTACN)Mn^{IV}(Âμ\text{-}0)_3Mn^{IV}(Me\text{-}MeTACN)]^{2+}(PF_6^-)_2$ (III) $[(Me\text{-}TACN)Mn^{III}(Âμ\text{-}0)(Âμ\text{-}OAc)_2Mn^{III}(Me\text{-}TACN)]^{2+}(PF_6^-)_2$ (IV) $[(Me\text{-}MeTACN)Mn^{III}(Âμ\text{-}0)(Âμ\text{-}OAc)_2Mn^{III}(Me\text{-}MeTACN)]^{2+}(PF_6^-)_2$ which hereinafter may also be abbreviated as:

(I) $[Mn^{IV}{}_2(Âμ\text{-}0)_3(Me\text{-}TACN)_2](PF_6)_2$ (II) $[Mn^{IV}{}_2(Âμ\text{-}0)_3(Me\text{-}MeTACN)_2](PF_6)_2$ (III) $[Mn^{III}{}_2(Âμ\text{-}0)(Âμ\text{-}OAc)_2(Me\text{-}TACN)_2](PF_6)_2$ (IV) $[Mn^{III}{}_2(Âμ\text{-}0)(Âμ\text{-}OAc)_2(Me\text{-}TACN)_2](PF_6)_2$ The structure of I is given below:

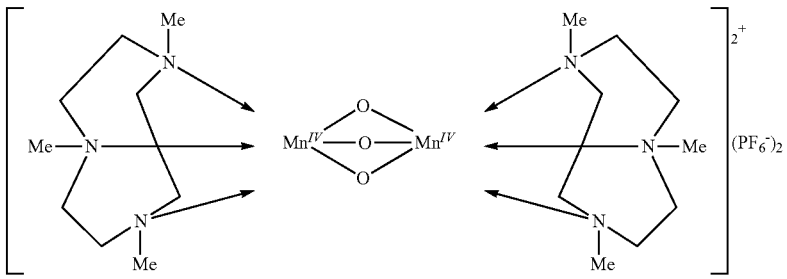

abbreviated as $[Mn^{IV}{}_2(Âμ\text{-}0)_3(Me\text{-}TACN)_{2](}PF_6)_2$.

The structure of II is given below:

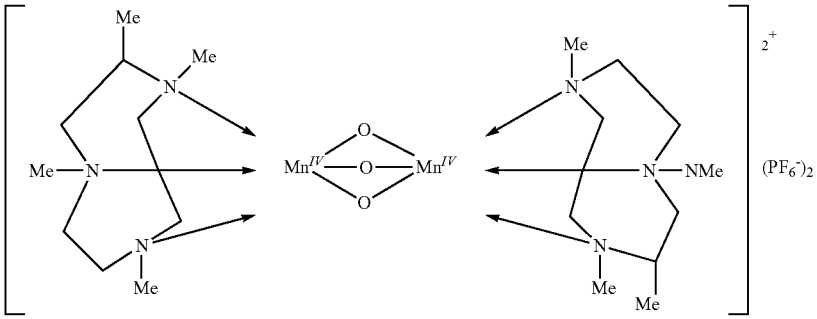

abbreviated as $[Mn^{IV}_2(\hat{A}\mu\text{-}0)_3(Me\text{-}MeTACN)_2](PF_6)_2$.

It is of note that the manganese complexes are also disclosed in EP-A-0458397 and EP-A-0458398 as unusually effective bleach and oxidation catalysts. In the further description of this invention they will also be simply referred to as the "catalyst".

Preferably the composition of the invention comprises from 0.001 to 1, more preferably from 0.002 to 0.01 grams of bleach catalyst. Preferably the bleach catalyst is a manganese bleach catalyst.

Inorganic Builder

The composition of the invention preferably comprises an inorganic builder. Suitable inorganic builders are selected from the group consisting of carbonate, silicate and mixtures thereof. Especially preferred for use herein is sodium carbonate. Preferably the composition of the invention comprises from 1 to 8, more preferably from 2 to 6 and especially from 3 to 5 grams of calcium carbonate.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH)R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Amine oxides surfactants are useful for use in the composition of the invention. Preferred are C10-C18 alkyl dimethylamine oxide, and C10-18 acylamido alkyl dimethylamine oxide.

Surfactants may be present in amounts from 0.1 to 10, more preferably from 0.5 to 5 and especially from 0.8 to 3 grams.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, 5130A, Y167A, R1705, A194P, V205I and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+5130A
(ii) S101M+G118V+S128L+P129Q+S130A
(iii) N76D+N87R+G118R+S128L+P129Q+5130A+S188D+N248R
(iv) N76D+N87R+G118R+S128L+P129Q+5130A+S188D+V244R
(v) N76D+N87R+G118R+S128L+P129Q+S130A
(vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 7 and especially from about 1 to about 6 mg of active protease.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643: 9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.
(b) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, S255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Additional Enzymes

Additional enzymes suitable for use in the product of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 1, more preferably from 0.05 to 0.8 grams of a crystal growth inhibitor, preferably HEDP.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.001 to 0.01, more preferably from 0.002 to 0.009 grams, preferably the metal care agent is benzo triazole (BTA).

Glass Care Agents

Glass care agents protect the appearance of glass items during the dishwashing process. Preferably the composition of the invention comprises from 0.001 to 1, more preferably from 0.002 to 0.5 grams of a glass care agent, preferably the glass care agent is a zinc salt.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

EXAMPLES

Two dual-compartment automatic dishwashing pouches were made comprising the ingredients detailed herein below (Composition 1 (comparative) and Composition 2 (according to the invention)). The pouches were made of polyvinyl alcohol (Monosol 8630 available from Kuraray) with the solid and liquid components in different compartments.

| Ingredients (active grams) | Composition 1 | Composition 2 |
|---|---|---|
| Solid | | |
| MGDA | 5.00 | 6.00 |
| Sulphonated Polymer | 1.20 | 0.40 |
| Sodium carbonate | 4.00 | 4.00 |
| Amylase | 0.004 | 0.004 |
| Protease | 0.034 | 0.034 |
| Sodium Percarbonate | 2.00 | 2.00 |
| Bleach catalyst and bleach activator | 0.004 | 0.004 |
| HEDP | 0.10 | 0.10 |
| Miscellaneous | Balance to 15.26 | Balance to 15.26 |
| Liquid | | |
| Plurafac SLF-180 | 0.84 | 0.84 |
| Lutensol TO7 | 0.89 | 0.89 |
| Miscellanous | Balance to 2.18 | Balance to 2.18 |
| pH of 1% w/v in deionised water | 10.71 | 10.99 |
| RA at pH = 9.5 in NaOH | 9.47 | 14.31 |
| 100 mL of solid product | | |

MGDA Tri-sodium salt of methyl glycine diacetic acid.
Amylase Stainzyme plus ® avalable from Novozymes
Protease Ultimase ® avalable from DuPont
Bleach activator TAED (Tetraacetylethylenediamine)
Bleach catalyst Manganese bleach catalyst
HEDP 1-hydroxyethylidene 1,1-diphosphonic acid
Plurafac SLF-180 Nonionic surfactant supplied by BASF
Lutensol TO7 Nonionic surfactant supplied by BASF
RA Reserve alkalinity Tea Stain Removal Test Eight cups per test leg were stained using black tea (Assam) prepared in artificially hard water with ferric sulphate as per IKW test method (IKW working group automatic dishwasher detergents. "Methods for Ascertaining the Cleaning Performance of Dishwasher Detergents (Part B, updated 2005)". SÖFW-Journal, 132, 8-2006 pp. 35). For each composition, two cups were placed on the top rack of a dishwasher, loaded with ballast dishes, and washed using Compositions 1 and 2. The inlet water had a hardness of 360 ppm of $CaCO_3$.

As artificial ballast 100 g of IKW soil and 36 g of minced meat were added from frozen. Artificial IKW soil was prepared according the IKW procedure and the meat soil was prepared by mixing 225 g of minced meat (50% pork and 50% beef), 75 g of eggs (white and yolk) and 80 g of water (350 $CaCO_3$ ppm hardness), and blending it until forming a paste, then it is divided in pots containing 36 g of the minced meat paste each and stored in a freezer.

The test was carried out in a Miele GSL dishwashing machine in a normal R-50° C. cycle (no pre-wash). The detergent is added to the dishwasher when the dispenser door opens. The test was repeated three more times with the remaining cups, once all of them were washed, the eight cups were graded by three independent judges, using a visual scale from 1 to 10 going from soiled to completely clean.

| | Composition 1 | Composition 2 |
|---|---|---|
| Visual tea grade | 3.9 | 8.1 |

Composition 2, according to the invention, provides much better tea cleaning that Composition 1, outside the scope of the invention.

Multi-Cycle Filming and Spotting Tests

A "Rinsing efficiency and limescale prevention test" was conducted in Eurofins ATS (1140 Rue André Ampère, 13851 Aix-en-Provence, France) the test consists in assessing the product ability to carry out the rinsing function and limescale prevention, that is to say to leave the washed dishes with the less spot, streaks and filming possible, by restoring its initial shine. Test conditions: 30 wash cycles at 55° C., Universal cycle-Miele dishwashers-, water hardness 350 $CaCO_3$ ppm.

Artificial IKS soil (form the IKW method) was introduced at the beginning of each cycle, in order to reproduce a cycle in soiled conditions.

Different materials representing what is usually washed in a dishwasher were used: ceramic plates, glasses, plastics, stainless steel cutleries. Materials were visually assessed under two types of lights, daylight in order to detect major faults and stronger artificial light to detect minor faults. Each item was examined under the two types of lights and grading on the following scales:

Film: from 1 to 4 (1 is heavily filmed and 4 is no film at all)

Spots and streaks: from 0 to 8 (0 is heavily spotted and 8 is not spots at all)

The assessment of the filming was carried out after thirty wash cycles, while the assessment of the spotting was carried out only after five cycles because beyond this number of cycles the films deposits disturb and inhibit the development of spots.

Compositions 1 and 2 showed equal performance on filming. Composition 2, according to the invention, showed better performance on spot prevention. This was surprising as the polymer level was considerably lower in the composition of the invention than in the comparative composition

| | Film grades After 30 cycles | | Spot grades after 5 cycles | |
|---|---|---|---|---|
| | Composition 1 | Composition 2 | Composition 1 | Composition 2 |
| Glass | 3.5 | 3.5 | 4.3 | 5.3 |
| Plastic | 3.1 | 3.1 | 4.8 | 5.0 |
| Stainless Steel | 3.8 | 3.8 | 4.7 | 6.4 |
| Black plates | 3.3 | 3.3 | 5.1 | 5.6 |

Cleaning Tests

Compositions 1 and 2 were also compared for their cleaning performance using CFT tiles, (Center For Testmaterials BV. Stoomloggerweg 11, 3133 KT Vlaardingen, the Netherlands), which are stained melamine dishwasher monitors that discriminate the performance of the product to remove enzyme sensitive stains among others.

Two tiles per wash of each stain are placed on the top rack of a Miele 1022 dishwashing machine, additional 50 g of IKW frozen ballast are added at the beginning of the wash. The inlet water had a water hardness of 376 $CaCO_3$ ppm and the cycle used was R-50° C. (no pre-wash). The test is repeated three more times using new tiles each time. At the end the tiles are evaluated using a computer aided image analysis to assign a stain removal index, having a continuous scale from 0 to a 100, where 0% is unwashed and 100% is a complete removal of the stain.

| | Composition 1 | Composition 2 |
|---|---|---|
| Egg yolk | 71.4 | 80.3s |
| Egg yolk/milk | 73.7 | 83.3 |
| Baked diet cheese | 78.5 | 79.7 |

Composition 2, according to the invention, provides better proteinaceous removal than comparative Composition 1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A phosphate-free automatic dishwashing detergent composition in unit-dose form having a weight of from about 8 to about 25 grams, the composition comprising:

i) from about 5.5 to about 7 grams of a salt of methyl glycine diacetic acid;

ii) from about 0.3 to about 0.5 grams a dispersant polymer;

iii) from about 1 to about 3 grams of sodium percarbonate;

and wherein the dispersant polymer is a sulfonated polymer comprising 2-acrylamido-2-methylpropane sulfonic acid monomers and carboxyl monomers, wherein the salt of methyl glycine diacetic acid and the sulfonated polymer are in a weight ratio of from about 10:1 to about 20:1, wherein the composition is free of manganese bleach catalyst.

2. A composition according to claim 1 wherein the composition is substantially free of citrate.

3. A composition according to claim 1 wherein the composition further comprises an enzyme selected from amylase, protease and a mixture thereof.

4. A composition according to claim 1 wherein the composition further comprises from 0.05 to 0.8 grams of a crystal growth inhibitor.

5. A composition according to claim 1 said composition has a pH equal or greater than 9 to 12 as measured in 1% weight/volume aqueous solution at 20° C.

6. A composition according to claim 1 having a reserve alkalinity equal or greater than about 10 to about 20 at a pH of 9.5 as measured in NaOH with 100 mL of product at 20° C.

7. A method of cleaning dishware in an automatic dishwasher comprising the step of subjecting the dishware to a wash liquor comprising a composition according to claim 1.

8. A method of cleaning dishware in an automatic dishwasher comprising the step of subjecting the dishware to a wash liquor comprising a composition according to claim 1 wherein the cleaning takes place using hard water.

* * * * *